US008382021B2

(12) United States Patent
Kuo

(10) Patent No.: US 8,382,021 B2
(45) Date of Patent: Feb. 26, 2013

(54) BOBBIN

(76) Inventor: Kun-Cheng Kuo, Tainan (TW)

( * ) Notice: Subject to any disclaimer, the term of this patent is extended or adjusted under 35 U.S.C. 154(b) by 295 days.

(21) Appl. No.: 12/806,143

(22) Filed: Aug. 6, 2010

(65) Prior Publication Data

US 2012/0032022 A1 Feb. 9, 2012

(51) Int. Cl.
*B65H 75/12* (2006.01)
*B65H 75/28* (2006.01)

(52) U.S. Cl. ..... 242/118.3; 242/125.1; 242/586.2; 242/613.2; 242/613.5

(58) Field of Classification Search ..... 242/172, 242/579, 586, 586.2, 587, 587.2, 587.3, 600, 242/613, 613.1, 613.2, 613.5, 615, 118, 118.2, 242/125–125.3, 606, 118.3–118.32
See application file for complete search history.

(56) References Cited

U.S. PATENT DOCUMENTS

| | | | | | |
|---|---|---|---|---|---|
| 909,986 | A * | 1/1909 | Burke | ..... | 40/309 |
| 1,211,678 | A * | 1/1917 | Connelly | ..... | 242/125.1 |
| 2,222,039 | A * | 11/1940 | Mahoney | ..... | 242/176 |
| 2,565,562 | A * | 8/1951 | Keight | ..... | 242/597.6 |
| 3,032,292 | A * | 5/1962 | Levinson | ..... | 242/125.2 |
| 7,445,177 | B2 * | 11/2008 | Wittmann et al. | ..... | 242/607.1 |

* cited by examiner

*Primary Examiner* — William E Dondero
(74) *Attorney, Agent, or Firm* — William E. Pelton, Esq.; Cooper & Dunham LLP

(57) ABSTRACT

A bobbin has a body and a ring. The body has a seat, a spool and a winder. The seat has a taper surface with multiple stairs. The stairs have a guiding surface, and the guiding surfaces of all of the stairs face to a same direction. The spool is formed on the top of the seat. The winder is formed on the bottom on the seat. The ring is removably mounted on the winder to form an annular gap between the seat and the ring. A secured end of thread is wound around the annular gap. A free end of thread is wound around the seat and extends curvedly over one of the stairs. Therefore, the stairs each having one guiding edge prevent the thread from being broken.

8 Claims, 6 Drawing Sheets

BOBBIN

BACKGROUND OF THE INVENTION

1. Field of the Invention

The present invention relates to a bobbin, and more particularly to a bobbin that can secure threads stably.

2. Description of Related Art

Bobbins are used for storage of threads. A thread has a free ends and a secured end attached to the bobbin and wound around the. The bobbin with threads is rotatably mounted on a rack or a sewing machine for sewing or weaving.

With reference to FIG. 5, a conventional bobbin comprises a body 90, a winder 93, a spool 91 and a ring 92. The body 90 is conical and has a bottom, a top and a taper surface. The taper surface connects the top and the bottom and forms a notch 94 adjacent to the bottom of body 90. The notch 94 of the body 90 forms two guiding edges 95 on the taper surface of the body 90. The winder 93 is formed on and protrudes from the bottom of the body 90. The spool 91 is formed on and protrudes from the top of the body 90. The ring 92 is removably mounted on the winder 93.

The secured end of the thread 96 is wound around an annular gap 97 formed between the ring 92 and the winder 93. The free end of the thread 96 extends from the notch 94 of the body 90 and is wound around the spool 91. The thread 96 is guided from one of the guiding edges 95 of the notch 94.

To hold the free end of the thread 96 when the thread 96 is not in use, the free end of the thread 96 is wound around the taper surface of the body 90, curvedly extends over one of the guiding edges 95 of the notch 94 and is securely held in the gap 97. However, one of the guiding edges 95 of the notch 94 will interfere with and rub on the thread 96 during the winding process of the thread 96. Therefore the thread 96 is broken easily.

To overcome the shortcomings, the present invention provides a bobbin to mitigate or obviate the aforementioned problems.

SUMMARY OF THE INVENTION

The main objective of the invention is to provide a bobbin that prevents thread from being broken.

A bobbin has a body and a ring. The body is mounted rotatably and has a seat, a spool and a winder. The seat has a taper surface with multiple stairs. The stairs have a guiding surface, and the guiding surfaces of all of the stairs face to a same direction. The spool is formed on the top of the seat. The winder is formed on the bottom on the seat. The ring is removably mounted on the winder to form an annular gap between the seat and the ring. A secured end of thread is wound around the annular gap. A free end of thread is wound around the seat and curvedly passes one of guiding edges of the stairs. Therefore, the stairs each having one guiding edge prevent thread from being broken.

Other objectives, advantages and novel features of the invention will become more apparent from the following detailed description when taken in conjunction with the accompanying drawings.

DETAILED DESCRIPTION OF PREFERRED EMBODIMENT

Figure 1:
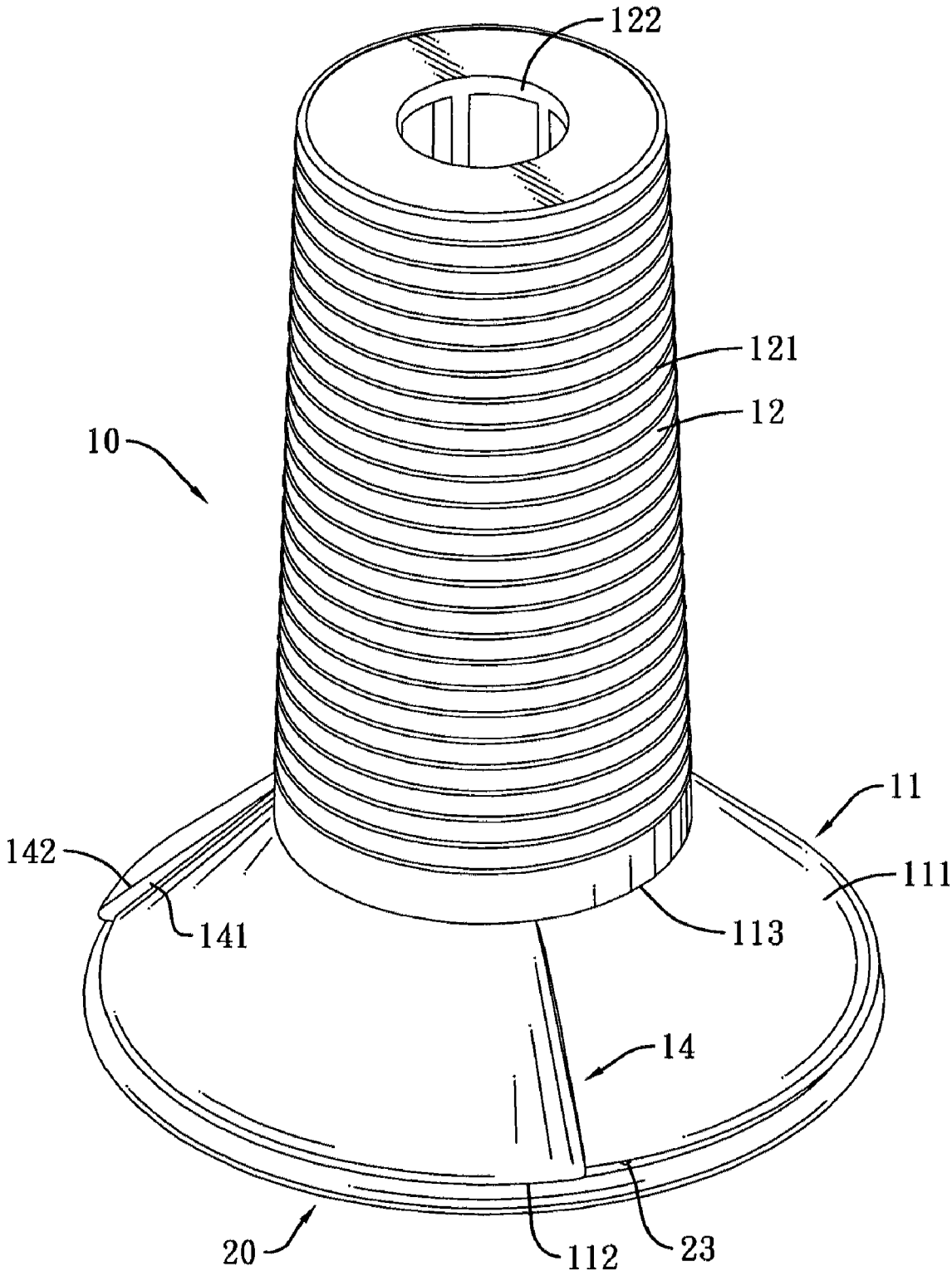
FIG. 1 is a perspective view of a bobbin in accordance with the present invention.
Figure 2:
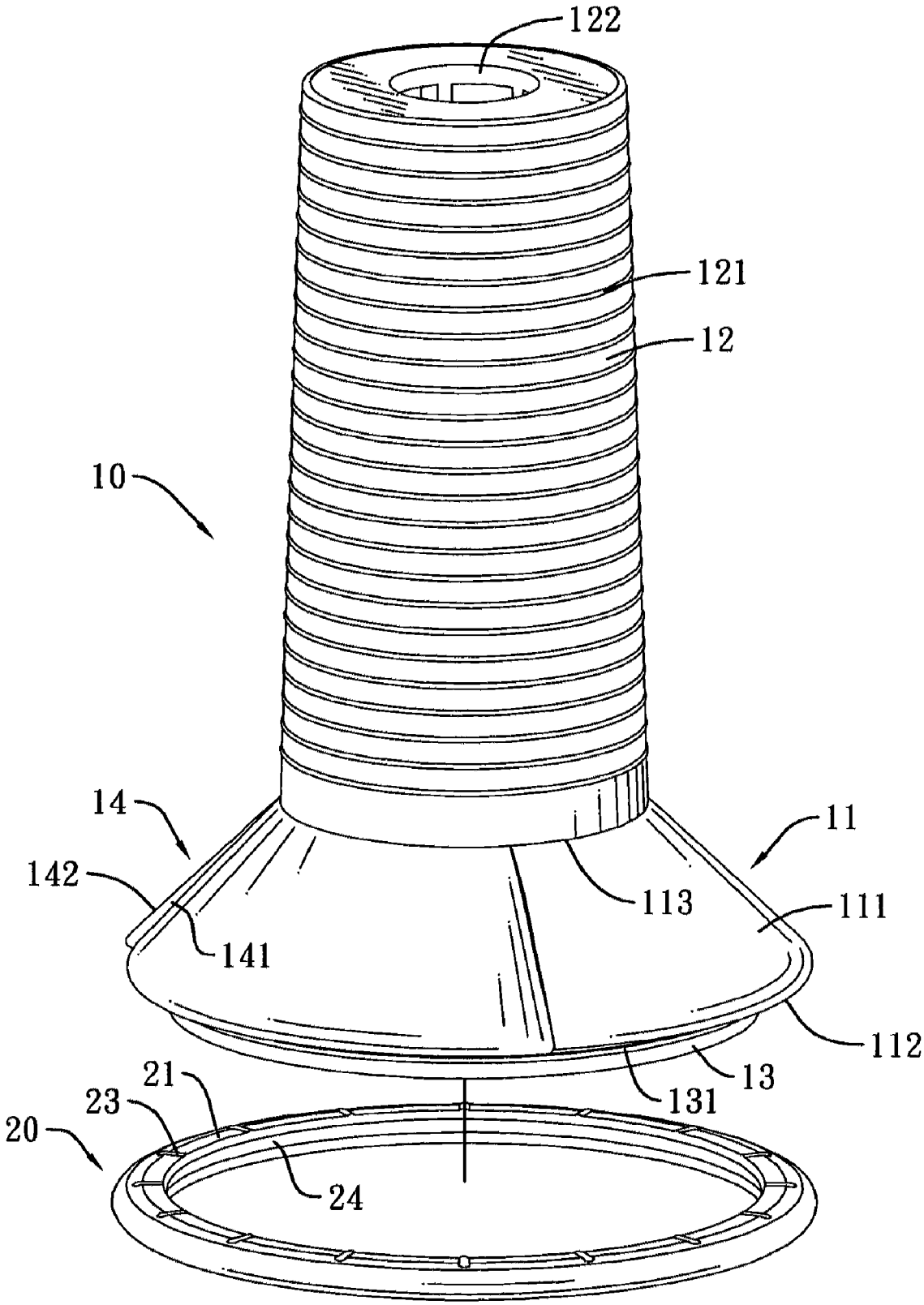
FIG. 2 is an exploded perspective view of the bobbin in FIG. 1.

With reference to FIGS. 1 and 2, a bobbin in accordance with the present invention comprises a body 10 and a ring 20.

The body 10 has a seat 11, a spool 12 and a winder 13. The seat 11 is conical and has a top 113, a bottom 112, a lower surface 114, a tapered surface 111 and multiple stairs 14. The stairs 14 are formed radially on the tapered surface 111. Each stair 14 extends from the top of the seat 11 to the bottom of the seat 11 and has a guiding surface 141, and guiding surfaces 141 of all of the stairs 14 face to a same direction. The direction is same as the rotational direction of the body 10 or reverse to the rotational direction of the body 10. The guiding surface 141 is formed on the tapered surface 111 and has a guiding edge 142.

The spool 12 is cylindrical and is formed on the top of the seat 11. The spool 12 has a top, a hole 122 and an outer surface and may have multiple protrusions 121. The hole 122 is formed in the top of the spool 12 and longitudinally through the spool 12 and the seat 11. The hole 122 is rotatably mounted on a rack, a sewing machine or the like. The protrusions 121 are formed on the outer surface of the spool 12 and provide friction to prevent a thread 30 that is wound on the spool 12 from sliding down and the protrusions 121 may be annular.

Figure 3:
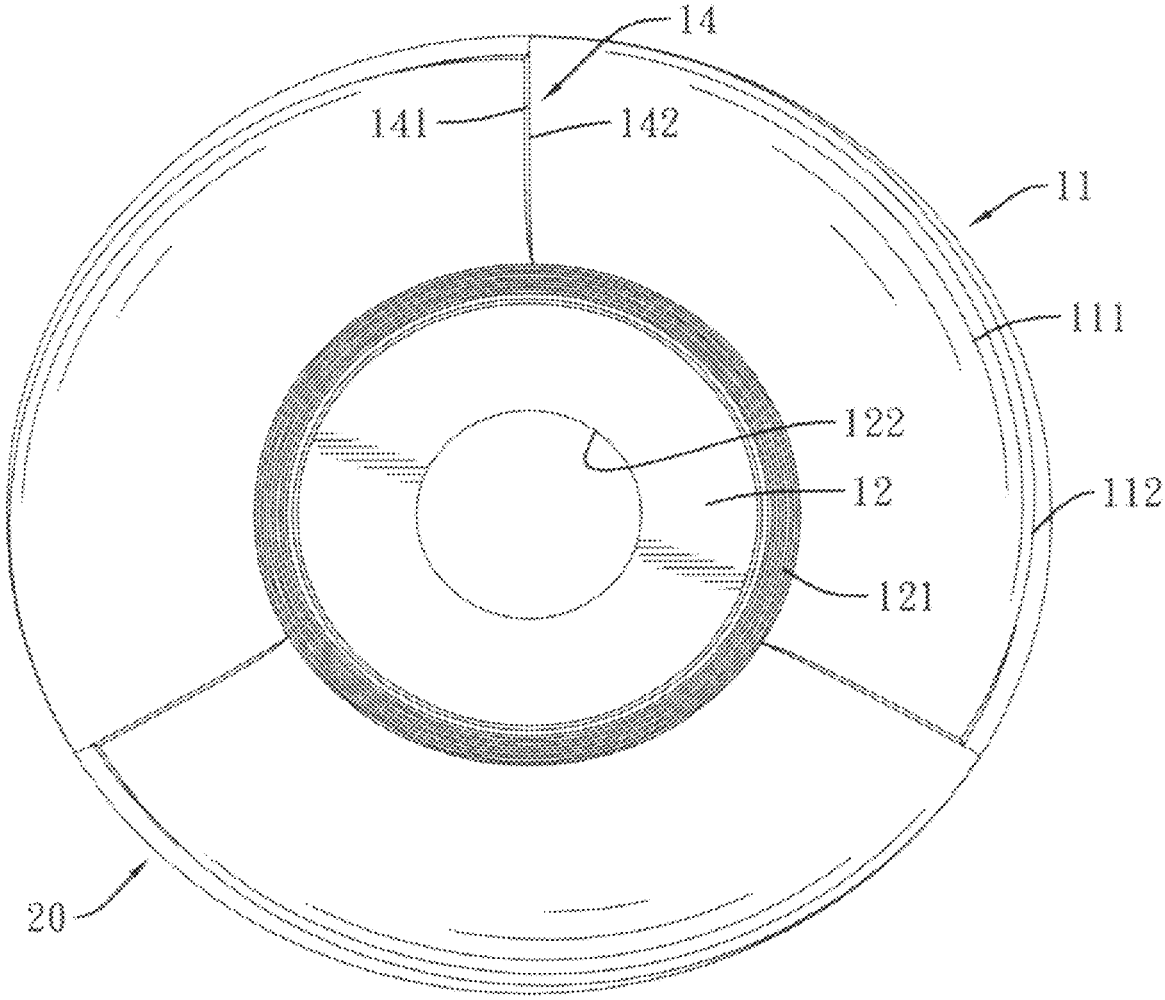
FIG. 3 is a top view of the bobbin in FIG. 1.
Figure 4A:
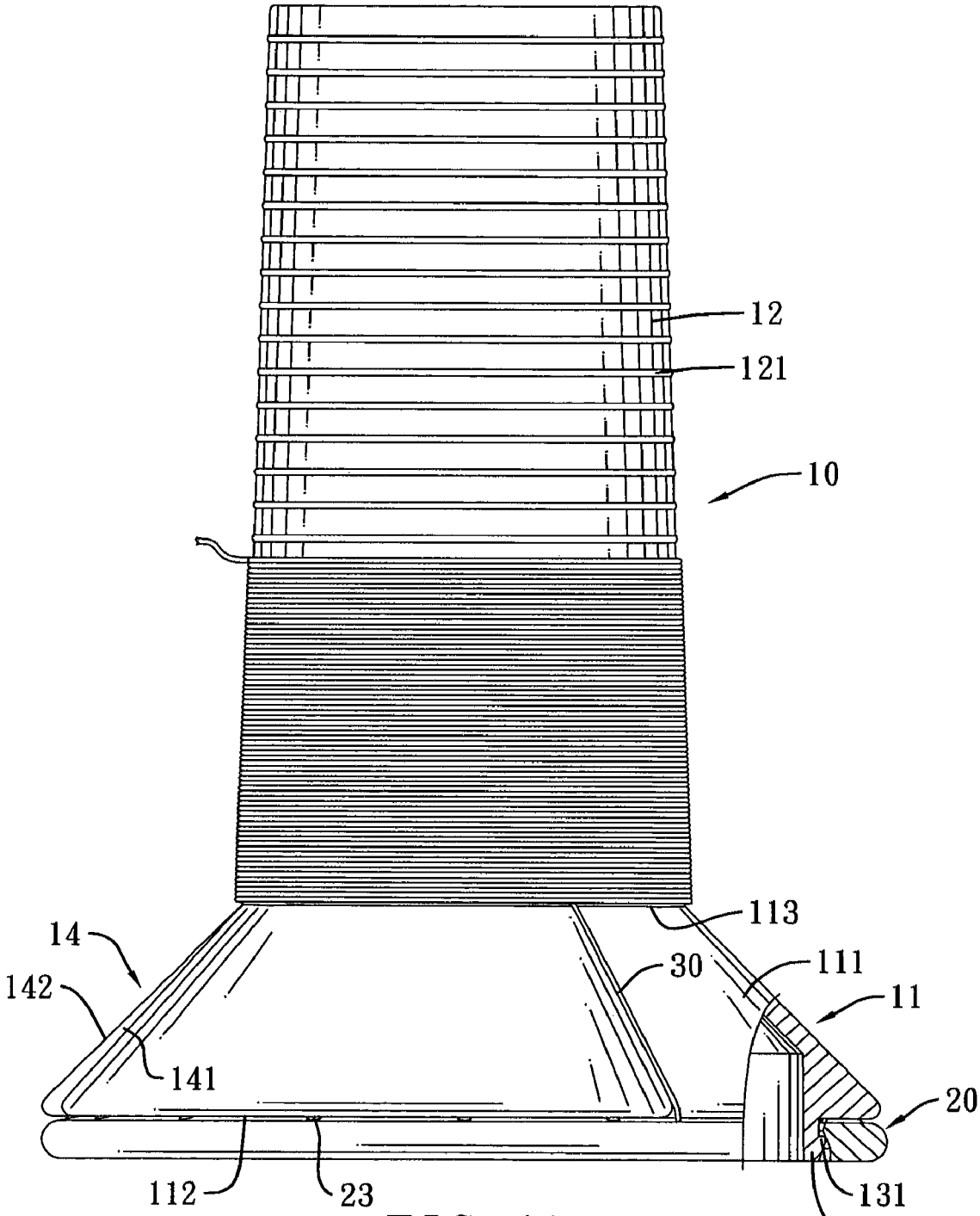
FIG. 4A is a side view in partial section of the bobbin in FIG. 1.
Figure 4B:
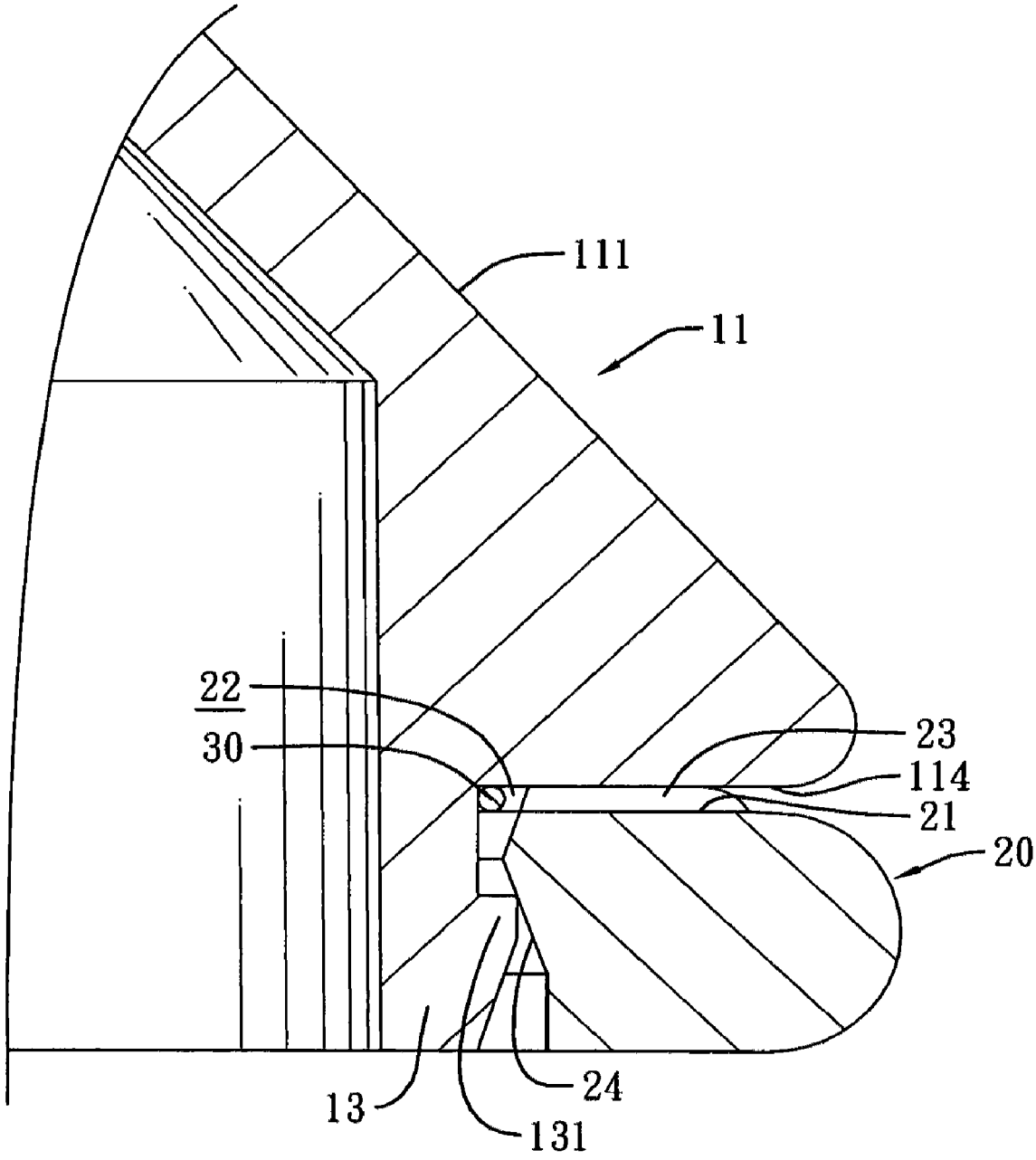
FIG. 4B is an enlarged cross sectional side view of the bobbin in FIG. 4A.
Figure 5:
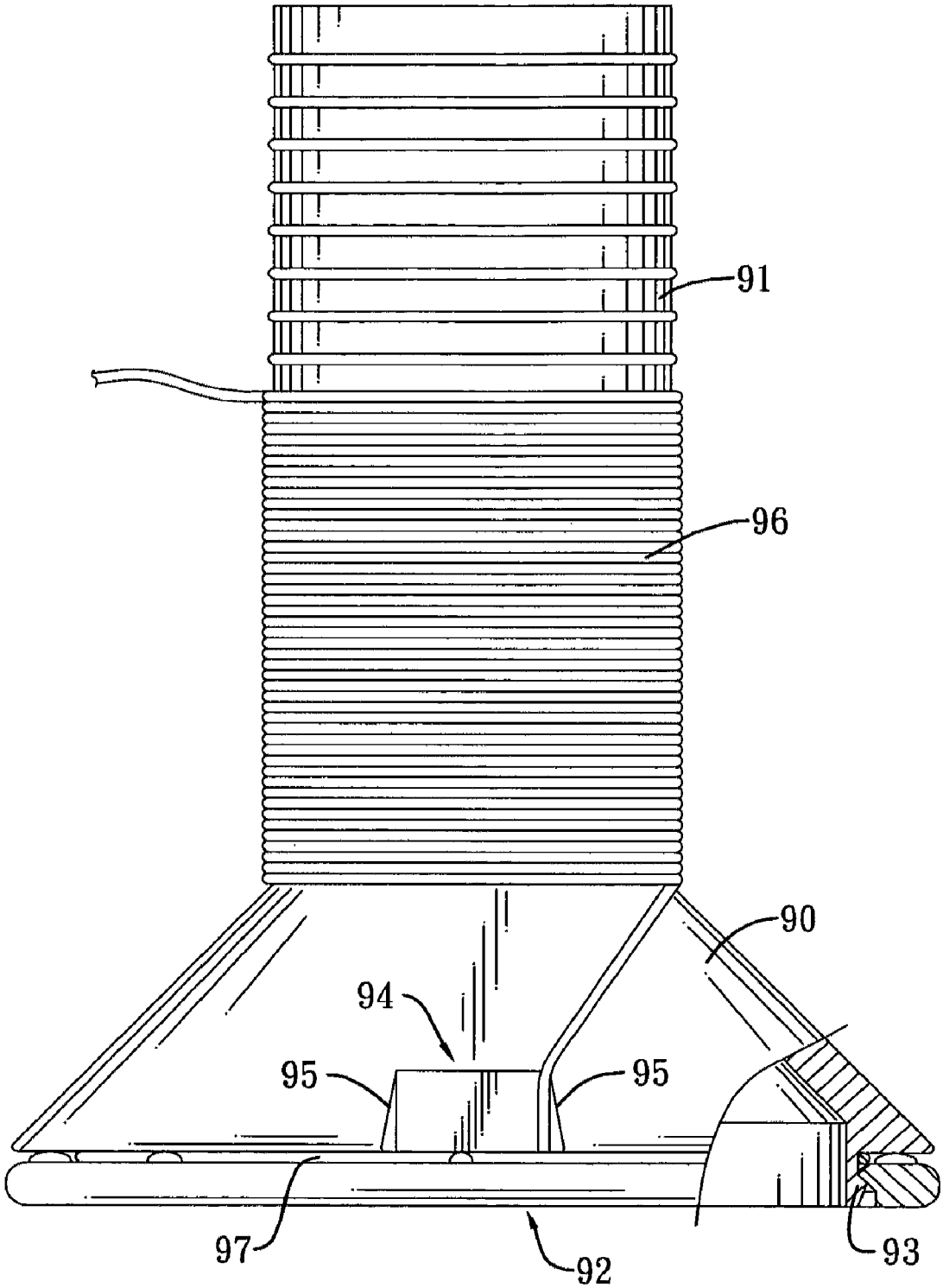
FIG. 5 PRIOR ART
FIG. 5 is a perspective view of a conventional bobbin.

With further reference to the FIGS. 3, 4A and 4B, the winder 13 is formed on and protrudes from the bottom 112 of the seat 11. The winder 13 has an annular surface and may have an installing portion 131. The installing portion 131 is formed in the annular surface.

The ring 20 is removably mounted on the winder 13 of the body 10 and forms an annular gap 22 between the ring 20 and the lower surface 114 of the seat 11. The ring 20 has an inner surface, an upper surface 21 and multiple teeth 23 and may have a mounting portion 24. The teeth 23 are formed on and protrude from the upper surface 21 of the ring 20 and may be half ellipsoids and allow thread 30 to be disposed between the teeth 23 and the annular surface of the winder 13. Each tooth may have a top edge abutting the lower surface 114 of the seat 11 when the ring 20 is mounted on the winder 13. The mounting portion 24 is formed on the inner surface of the ring 20 and corresponds to the installing portion 131 of the winder 13 and may be an annular protrusion corresponding to the annular groove of the winder 13.

A thread 30 having a secured end is installed by removing the ring 20 from the winder 13, winding the secured end of the thread 30 around the annular surface of winder 13 and reinstalling the ring 20 on the winder 13 so the thread 30 is disposed in the annular gap 22 and the thread 30 is limited between the teeth 21 and the winder 13. Then, the thread 30 is fed through the at least one stair 14 and wound around the spool 12. The thread 30 has a free end. When users reel up-and fix the free end of the thread 30, the free end of the thread 30 is wound around the body 10 and curvedly passes the guiding edge 142 on one of the stairs 14

Because the guiding surfaces 141 of all of the stairs 14 face to the same direction and each stair 14 of the body 10 has only one guiding edge 142, the thread 30 can be kept from being rubbed against by the guiding edges 142 of the guiding surfaces 141 when the free end of the thread 30 is wound around the body 10 along a direction opposite to that of the guiding surfaces 141 facing. Therefore, the thread 30 can be prevented from being broken Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A bobbin comprising:

a body having a seat being conical and having a top;

a bottom;

a tapered surface;

multiple stairs formed radially on the tapered surface, extending from the top of the seat to the bottom of the seat and each having a guiding surface formed on the tapered surface of the body and having a guiding edge, wherein the guiding surfaces of all of the stairs face to a same direction;

a spool being cylindrical and formed on the top of the seat and having a top;

a hole formed in the top of the spool and axially through the body;

a winder formed on and protruding from the bottom of the seat; and a ring being removably mounted on the winder to form an annular gap between the seat and the ring and having an upper surface; and multiple teeth formed on and protruding from the upper surface.

2. The bobbin as claimed in claim 1, wherein the winder further has an annular surface and an installing portion formed in the annular surface of the winder; and the ring has an inner surface and a mounting portion formed on the inner surface, corresponding to and mounted on the installing portion.

3. The bobbin as claimed in claim 2, wherein the spool has an outer surface and multiple protrusions formed on and protruding from the outer surface.

4. The bobbin as claimed in claim 3, wherein the teeth are half ellipsoids.

5. The bobbin as claimed in claim 2, wherein the teeth are half ellipsoids.

6. The bobbin as claimed in claim 1, wherein the spool has an outer surface and multiple protrusions formed on and protruding from the outer surface.

7. The bobbin as claimed in claim 6, wherein the teeth are half ellipsoids.

8. The bobbin as claimed in claim 1, wherein the teeth are half ellipsoids.

* * * * *